US005659869A

United States Patent [19]

Ohtsuka et al.

[11] Patent Number: 5,659,869

[45] Date of Patent: Aug. 19, 1997

[54] IMAGE FIXING APPARATUS HAVING PRESSURE ROLLER WITH FLUORINE SURFACE ACTIVE AGENT

[75] Inventors: Yasumasa Ohtsuka, Yokohama; Miho Aoki, Kawasaki; Yukihiro Ohzeki; Masaharu Ohkubo, both of Yokohama; Koichi Okuda, Tokyo, all of Japan

[73] Assignee: Canon Kabushiki Kaisha, Tokyo, Japan

[21] Appl. No.: 234,625

[22] Filed: Apr. 28, 1994

Related U.S. Application Data

[63] Continuation of Ser. No. 825,322, Jan. 27, 1992, abandoned, which is a continuation of Ser. No. 519,254, May 3, 1990, abandoned, which is a continuation of Ser. No. 201,870, Jun. 3, 1988, abandoned.

[30] Foreign Application Priority Data

| | | | |
|---|---|---|---|
| Jun. 5, 1987 | [JP] | Japan | 62-139917 |
| Mar. 8, 1988 | [JP] | Japan | 63-052648 |
| May 9, 1988 | [JP] | Japan | 63-111963 |

[51] Int. Cl.[6] ..... G03G 15/20

[52] U.S. Cl. ..... 399/333; 492/56

[58] Field of Search ..... 355/282, 285, 355/289, 290; 219/216, 469; 432/60; 492/18, 46, 53, 56; 399/333

[56] References Cited

U.S. PATENT DOCUMENTS

| | | | |
|---|---|---|---|
| 3,625,146 | 12/1971 | Hutchinson | 29/132 X |
| 3,662,446 | 5/1972 | Walls | 29/132 X |
| 3,846,151 | 11/1974 | Rotemann et al. | 355/284 X |
| 4,150,181 | 4/1979 | Smith | 432/60 X |
| 4,293,989 | 10/1981 | Schneider | 29/132 X |
| 4,313,981 | 2/1982 | Namiki | 29/130 X |
| 4,320,714 | 3/1982 | Shimazaki | 430/99 X |
| 4,325,998 | 4/1982 | Chapman | 29/132 X |
| 4,415,626 | 11/1983 | Hasenauer et al. | 430/124 X |
| 4,550,243 | 10/1985 | Inagaki | 219/469 X |
| 4,608,737 | 9/1986 | Parks et al. | 29/132 X |
| 4,616,917 | 10/1986 | Sakurai | 355/290 |
| 4,618,639 | 10/1986 | Takahashi et al. | 528/24 X |
| 4,640,600 | 2/1987 | Hirabayashi | 355/14 FU X |
| 4,722,017 | 1/1988 | Vannet et al. | 360/133 |
| 4,796,046 | 1/1989 | Suzuki et al. | 355/284 |

FOREIGN PATENT DOCUMENTS

| | | | |
|---|---|---|---|
| 0109077 | 6/1984 | Japan | 355/14 FU |
| 185374 | 10/1984 | Japan | 355/3 FU |
| 0063575 | 4/1985 | Japan | 355/3 FU |

*Primary Examiner*—Robert Beatty

*Attorney, Agent, or Firm*—Fitzpatrick, Cella, Harper & Scinto

[57] ABSTRACT

An image fixing apparatus includes a fixing roller contactable to an unfixed image, and a back-up roller cooperable with the fixing roller to fix the unfixed image, wherein the back-up roller contains a fluorine surface active agent having an antistatic effect substantially to reduce electrostatic offset and enable the back-up roller to remove toner deposited on the fixing roller.

16 Claims, 5 Drawing Sheets

IMAGE FIXING APPARATUS HAVING PRESSURE ROLLER WITH FLUORINE SURFACE ACTIVE AGENT

This application is a continuation of application Ser. No. 07/825,322, filed Jan. 27, 1992, now abandoned, which is a continuation of application Ser. No. 07/519,254, filed May 3, 1990, now abandoned, which was a continuation of application Ser. No. 07/201,870, filed Jun. 3, 1988, now abandoned.

FIELD OF THE INVENTION AND RELATED ART

The present invention relates to an image fixing device which is used particularly in the field of image fixing in an electrophotographic apparatus or an electrostatic recording apparatus, more particularly to an image fixing device having a pair of rollers forming a nip therebetween through which a sheet material carrying an unfixed toner image is passed to fix the image by pressure and/or heat.

A type of image fixing device wherein a sheet material for carrying an unfixed image is passed through a nip formed between two rollers, i.e. a fixing roller contactable to the unfixed image and a back-up roller for pressing the sheet material to the image fixing roller, is widely used for fixing the unfixed toner image on the sheet material. This type of image fixing device wherein heat and/or pressure is applied by the nip is particularly advantageous from the standpoint of decreasing the size of the device and the energy consumed by the device.

An example of the fixing device of this type includes a fixing roller having a hollow core metal made of aluminum, steel or the like and a coating layer thereon made of a material showing good parting property, such as PTFE (polytetrafluoroethylene), PFA (copolymer of perfluoroalkyl and perfluorovinylether), silicone rubber or the like. As required, the fixing roller contains therein a heater, such as halogen lamp or the like to raise the surface temperature of the fixing roller up to a desired level. In many cases, a sensor and a control system are used to maintain the surface temperature of the fixing roller at a predetermined level.

Around the outer periphery of the fixing roller, there are provided a cleaner for removing off-set toner or paper dust and separation pawls for preventing the sheet material from wrapping on the fixing roller.

On the other hand, a back-up roller press-contacted to the fixing roller includes a core metal of steel, stainless steel or the like and an elastic layer having a parting property, such as silicone rubber or the like. The back-up roller is pressed to the fixing roller by a spring or the like.

The sheet material carrying the unfixed toner image is passed through the nip formed between the fixing roller and the back-up roller under pressure, by which the toner image is fixed by pressure and/or heat.

As described, the surface of the image fixing roller is of a material exhibiting a good parting property, such as PTFE, PFA or the like, and therefore, the toner off-set to the fixing roller is decreased. However, the toner off-set is not completely removed, and therefore, it is usual that the off-set toner is removed by a cleaner made of felt or the like. Nevertheless, the toner which has not been removed by the cleaner is sooner or later transferred onto an image surface of the sheet material, thus deteriorating the resultant image.

Additionally, with an increase of number of image fixing operations in this type of image fixing device, the surface of the back-up roller is charged by triboelectrification to approximately 4 KV, by which the sheet material is wrapped on the back-up roller. In the case where the triboelectric charge polarity of the back-up roller is the same as the charge polarity of the unfixed toner image, the unfixed toner is scattered by the electric field created by the charge on the surface of the back-up roller, with the result of contamination of the image and the increase of an electrostatic off-set of the toner to the surface of the fixing roller.

More particularly, the back side of the sheet material is charged to a negative polarity, for example, before it enters the fixing device, and therefore, a repelling force is applied when the toner on the sheet material is negatively charged. In addition, since the back-up roller is also charged to a negative polarity by triboelectrification between the silicone rubber and the sheet material, the toner is strongly repelled by the potential resulting from those charges. Further, where the fixing roller has a surface layer of a fluorine resin, the surface is positively charged, and therefore, it attracts the toner on the sheet material in addition to the repelling force by the back-up roller. By the three or two electrostatic forces, the toner is scattered or off-set.

As a measure for obviating the charge on the back-up roller surface, Japanese Utility Model Application Publication 41793/1982 proposes that a charge removing brush is contacted. However, the charge removing effect is not so sufficient that approximately 2 KV of the charge potential can remain.

In order to prevent the off-set by the charge when the back-up roller is charged to a high potential, U.S. Pat. No. 4,616,917 proposes that electrification agents are contained in the roller to make the roller charge opposite to the toner charge. By this, the toner off-set can be remarkably decreased. However, the toner off-set to the fixing roller is attracted electrostatically to the back-up roller when the sheet material is not in the nip, and the toner electrostatically deposited on the back-up roller is not carried over to the outside with the sheet material, so that the back-up roller becomes contaminated significantly.

SUMMARY OF THE INVENTION

Accordingly, it is a principal object of the present invention to provide an image fixing device wherein the image is not contaminated by the toner off-set to the fixing roller.

It is another object of the present invention to provide an image fixing device wherein overcharging of the back-up roller is effectively prevented, by which a sheet material is prevented from electrostatic wrapping on the back-up roller, and also by which an electrostatic off-set is prevented.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
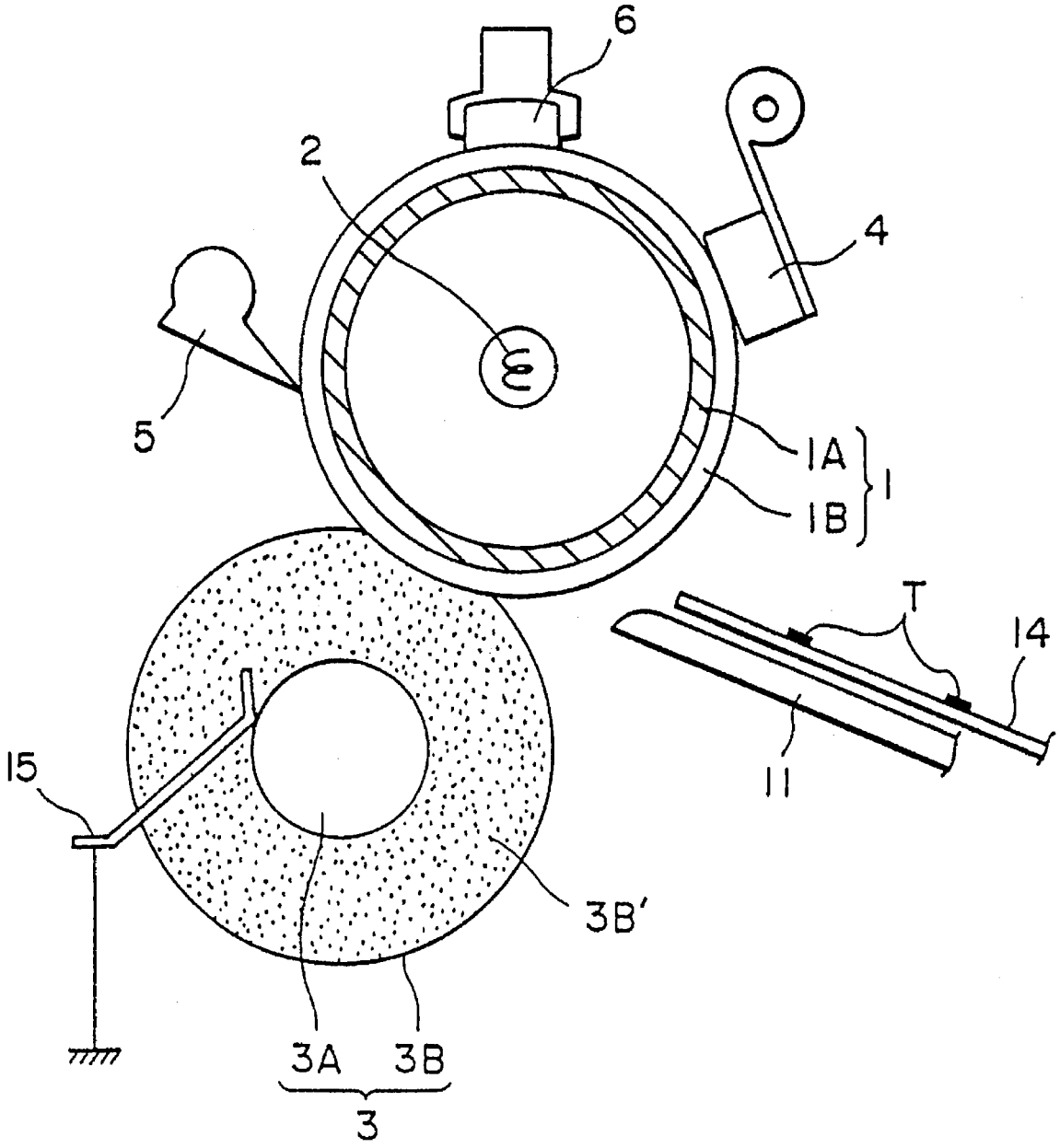
FIG. 1 is a cross-sectional view of an image fixing device according to an embodiment of the present invention.

The preferred embodiments of the present invention will be described in conjunction with the accompanying drawings wherein like reference numerals are assigned to the elements having corresponding functions.

Referring to FIG. 1, there is shown an image fixing device according to an embodiment of the present invention. The image fixing apparatus includes a fixing roller contactable to an unfixed toner image T, which roller includes a core metal 1A made of aluminum, steel, stainless steel or the like coated with a fluorine resin layer 1B showing a heat resistive property and a parting property, such as PFA or PTFE resin or the like. A heating source 2 such as a halogen heater is provided in the core metal 1A to heat the fixing roller up to a high temperature.

The fixing device further includes a back-up roller 3 press-contacted to the image fixing roller 1 so that the back-up roller 3 is rotated by the fixing roller 1. The back-up roller 3 includes a core metal 3A made of steel, stainless steel or the like and an elastic layer 3B showing a heat resistive property and a parting property, such as silicone rubber, fluorine rubber or the like. In the elastic layer 3B, a surface-active agent 3B' is contained and dispersed.

Around the fixing roller 1, a thermister 4 for detecting the temperature of the fixing roller 1, a separation pawl 5 for separating a sheet material 14 carrying an unfixed toner image from the image fixing roller 1, a cleaner 6 for contacting and cleaning the surface of the fixing roller 1 and an inlet guide 11 for guiding the sheet material 14 to the nip formed between the image fixing roller 1 and the back-up roller 3. To the core metal 3B of the back-up roller 3, a spring 15 made of conductive material is contacted, by which the back-up roller 3 is grounded.

In this embodiment, by dispersing a surface-active agent in the elastic layer of the back-up roller, the surface tension is decreased without roughening the back-up roller surface, that is, without disturbing the surface smoothness of the surface. By the decrease of the surface tension, the toner which has been off-set to the fixing roller 1 and which has not been removed by the cleaner 6 is transferred to the back-up roller during the time in which the sheet material is not in the nip, since the back-up roller has a smaller surface tension.

The toner transferred to the back-up roller is, during the image fixing operation, deposited on the back side of the sheet material having a very high activity, that is, a low surface tension, and the toner is carried with the sheet material. Therefore, the back-up roller is not contaminated remarkably.

In this manner, even if silicone rubber or fluorine rubber showing good properties for the surface layer of the back-up roller is used, the toner off-set to the fixing roller is discharged outside the device on the way of the back-up roller and the backside of the sheet material, thus minimizing the problem of contamination both in the fixing roller and the back-up roller.

The description will be made as to the remarkable decrease of the potential by the triboelectrification charge on the back-up roller surface by containing a surface-active agent in the back-up roller, on the basis of experiments.

EXPERIMENT 1

The fixing roller 1 included an aluminum core metal pipe having a diameter of 25 mm and a thickness of 0.8 mm, which was coated by PFA having 25 microns thickness. The back-up roller included a core metal shaft made of a stainless steel having a diameter of 10 mm, coated with a silicone rubber layer having a thickness of 5 mm. The silicone rubber had a hardness of 16 degrees (JIS-A). The surface temperature of the fixing roller 1 was controlled by the heater 2 to be approximately 180° C.

Figure 2:
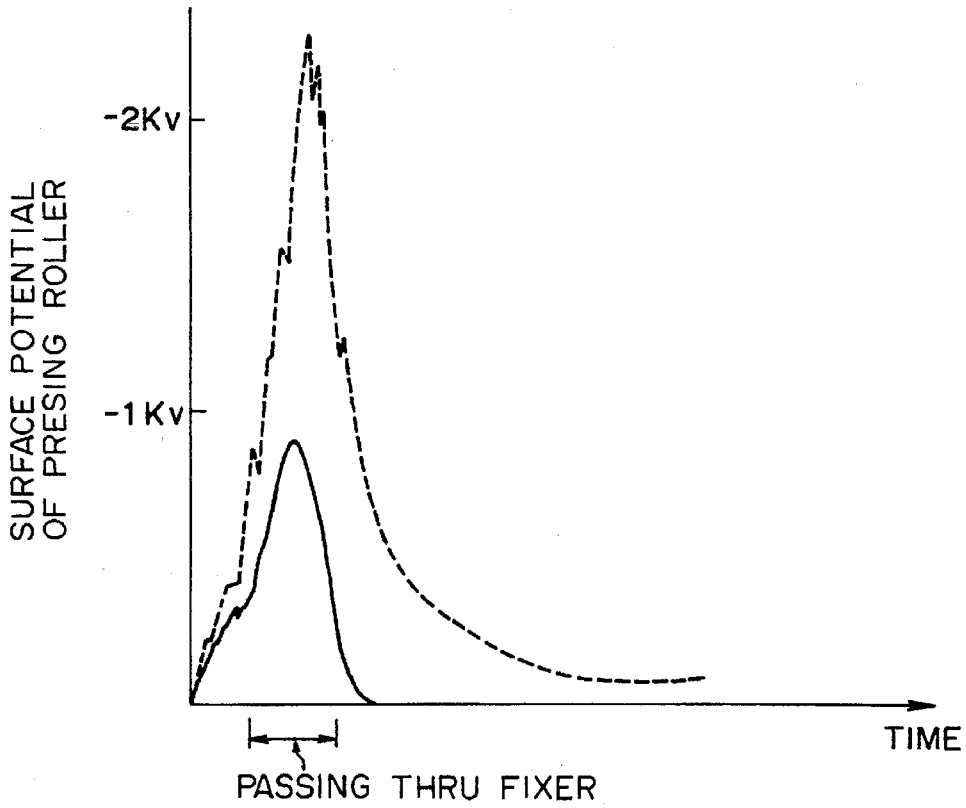
FIG. 2 is a graph of surface potential of pressing roller VS. time in a conventional device and a device according to the present invention.
Figure 3:
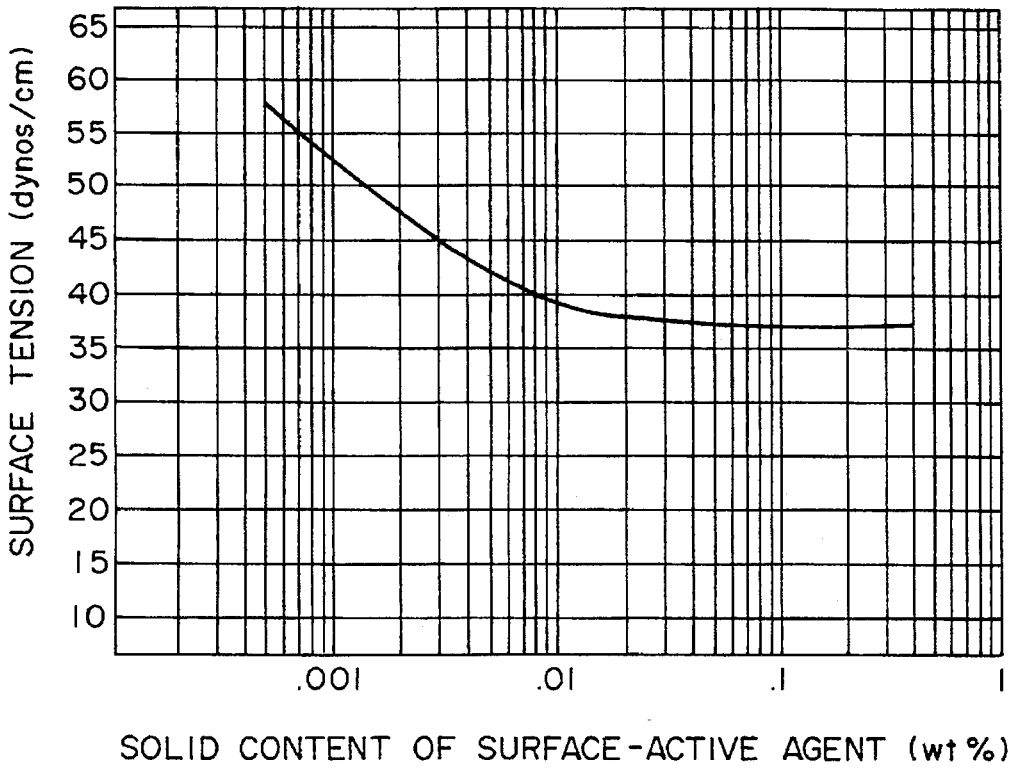
FIG. 3 is a graph showing surface tension VS. solid content of surface-active agent.

FIG. 2 is a graph of surface potential of the back-up roller or pressing roller VS. time for a silicone rubber not containing a surface-active agent and for a silicone rubber used in this embodiment. The silicone rubber free from the surface-active agent, as shown by a broken line, is charged to more than −2 KV by the friction between the back-up roller and the sheet material. In this experiment, 0.1% by weight of fluorinated alkyl ester, which was one of fluorine surface-active agents, was dispersed (0.001% by weight–0.3% by weight) in the silicone rubber. It has been confirmed that the surface potential of the back-up roller during passage of the sheet through the nip is decreased, as shown by a solid line in FIG. 2, down to below −1 KV, by the charge preventing effect of the surface-active agent.

The solid line and the broken line show the changes of the back-up roller surface potentials with elapse of time when one sheet is printed by each of the conventional device and the device according to the present invention. As will be understood from FIG. 2, by containing the surface-active agent in the silicone rubber, the charging of the back-up roller by the friction between the sheet material and the back-up roller can be constrained, and the attenuation of the surface potential of the back-up roller is made faster. By this, the sheet material is prevented from wrapping around the back-up roller.

The triboelectricity of the unfixed toner is usually about 1–30 micro-coulombs (absolute value), and therefore, even if the back-up roller is charged to the same polarity as that of the unfixed toner, the electrostatic toner off-set or toner scattering hardly occurs if the absolute value of the charge potential of the back-up roller is not more than 1 KV.

The amount of toner accumulated in the cleaner 6 contacted to the fixing roller 1 was not more than 1/10 of the conventional case, so that the decrease of the toner off-set was confirmed. In the fixed image, the line image was not smeared. In the case where, as in FIG. 1 embodiment, the fixing roller is heated by a heating source, a fluorine surface-active agent is preferable, because it is more heat-resistive than other surface-active agents.

When the surface of the fixing roller 1 is heated up to 140° C.–190° C., the surface temperature of the rubber layer of the back-up roller becomes as high as 110° C. or more, and therefore, a usual surface-active agent is decomposed, but the fluorine surface-active agents are so heat-resistive that the decomposition does not occur.

EXPERIMENT 2

In the Experiment 1 described above, fluorinated alkylester was used as the fluorine surface active agent, but other usable materials are perfluoroalkylpolyoxyethylene ethanol, perfluoroalkylcarboxylate, perfluoroalkylammonium salt, perfluoroalkyl betaine, perfluoroalkylamine oxide, perfluoroalkylethylene oxide adduct, perfluoroalkylphosphate ester, non-dissoiatable perfluoroalkyl compound and EFTOP-EF122B (trade name, available from Mitsubishi Kinzoku Kabushiki Kaisha, Japan).

The content of the fluorine surface-active agent in the silicone rubber was 0.1% by weight in the Experiment 1. The content is preferably between 0.003%–0.3% by weight, and further preferably it is between 0.01%–0.1% by weight.

The lower limit was determined from the standpoint of the effect of decreasing the surface tension which is the major effect of the surface-active agent. This is because, as described hereinbefore, by decreasing the surface tension of the back-up roller, the off-set toner on the fixing roller is collected to the back-up roller, and the collected toner is deposited on the backside of the sheet material to carry it out of the apparatus with the sheet material.

With the increase of the surface-active agent contained in the back-up roller, the charge preventing effect of the surface-active agent decreases the charged potential of the back-up roller. A sufficient charge removing effect was provided if the surface-active agent content was not less than 0.003% by weight. Further, by containing not less than 0.01% by weight, the surface tension was decreased down to the saturation level, and also the charge removing effect was increased up to a saturated level.

Therefore, it is preferable that the content of the surface-active agent is not less than 0.03% weight, and further preferably, it is not less than 0.01% by weight.

If, on the contrary, the content of the surface-active agent is too large, the rubber hardening is obstructed. The obstruction is significant if the surface-active agent content is not less than 0.3% by weight. Also, not less than 0.1% by weight of the surface-active agent content damages the elasticity of the rubber. Therefore, it is preferably not more than 0.3% by weight, further preferably, not more than 0.1% by weight.

In FIG. 1 embodiment, a leaf spring of a conductive material which is grounded is contacted to the core metal of the back-up roller, by which the back-up roller is grounded. By this grounding, the charge accumulated on the roller is released to the earth, so that the charge preventing effect for the back-up roller surface by the surface-active agent is further enhanced.

As for another means for grounding the back-up roller, a charge removing brush may be contacted to the surface of the roller. However, the grounding of the core metal is preferable since it is structurally simple and functionally stable.

EXPERIMENT 3

In the foregoing Experiments, the fluorinated surface-active agent was added to the rubber layer of the back-up roller. However, the surface-active agent was sometimes extracted gradually from the rubber layer with increased time of use. For example, in the Experiment 1, when more than 100,000 sheets (size A4) were printed the surface-active agent was significantly extracted from the rubber, the off-set preventing effect or the wrapping preventing effect tended to be decreased.

To provide a solution to this problem, a fluorine surface-active agent is added in the silicone oil impregnated in the cleaning felt of the cleaner 6 shown in FIG. 1 so that the surface-active agent is supplied to the back-up roller surface by way of the image fixing roller. It has been confirmed that by doing this, the extraction of the surface-active agent from the rubber is significantly decreased.

More particularly, the cleaning felt used was made of a woven material made of aromatic polyamideimide fibers having a density of 0.15 g/cm$^3$, a thickness of 6 mm, a width of 10 mm and a length of 220 mm. Into this felt, 2 g of dimethylsilicone oil (KF-96, 10,000 cs, available from Shinetsu Silicone Kabushiki Kaisha) was impregnated, and into the silicone oil, 0.06 g of fluorinated alkylester was added. By this, approximately 0.5 mg was applied to the fixing roller per one sheet (A4), and the felt was exchanged after 4000 sheets were fixed.

The results showed that the surface potential of the back-up roller could be maintained at a level not higher than −1 KV, so that the off-set preventing effect, the sheet wrapping preventing effect and the cleaning effect of the fixing roller by the back-up roller could be maintained.

In this case, the surface-active agent was fluorinated alkylester. However, this is not limiting, and suitable material can be selected from the fluorinated surface-active agents listed with respect to experiment 2.

The surface-active agent added into the silicone rubber of the back-up roller may be different from the one added into the silicone oil. However, preferably it is similar or the same.

As described, by applying the surface-active agent on the surface of the roller containing the surface-active agent, the extraction of the surface active agent in the roller can be prevented, and the effect of preventing the charge on the roller surface is further enhanced.

The content of the surface-active agent in the silicone oil is preferably not less than 0.003% by weight, and further preferably, not less than 0.01% by weight. The upper limit is determined by gelation, since the gelation occurs in some of the surface-active agents, depending on the content in the silicone oil. More particularly, the silicone oil was not gelated if the surface-active agent content is not more than 3% by weight. Since the fluorine surface-active agents, particularly those exhibiting heat resistivity, are expensive, the lower content is better. The preferable range is 0.003% by weight–3% by weight, and a further preferable range is 0.01% by weight to 1% by weight.

As an alternative, a felt into which the silicone oil containing the surface-active agent is impregnated, is directly contacted to the surface of the back-up roller 3. By doing so, the fluorinated surface-active agent can be efficiently supplied to the back-up roller surface.

If the rubber layer of the back-up roller is of a multi-layer structure in this or foregoing Experiments, it is preferable that the surface-active agent is contained in all of the layers, but the minimum requirement is that the outermost layer contains the surface-active agent. If it is contained only in the outermost layer, the amount of use of the fluorine surface-active agent may be minimized, and therefore, the desired performance can be provided with low cost.

EXPERIMENT 4

In the foregoing Experiments, the surface temperature of the fixing roller 1 was as high as about 180° C., and therefore the fluorine surface-active agent was used. However, when a low temperature fusing toner is used, and the fixing operation is performed with the surface temperature of about 140° C. on the surface of the fixing roller, the surface temperature of the back-up roller 3 is as low as about 90° C. Therefore, the decomposition temperature of the surface-active agent added in the back-up roller 3 is satisfactory if it is not less than 100° C. Therefore, in this case, a less heat resistive surface-active agent which is not a fluorine surface-active agent is usable.

Figure 4:
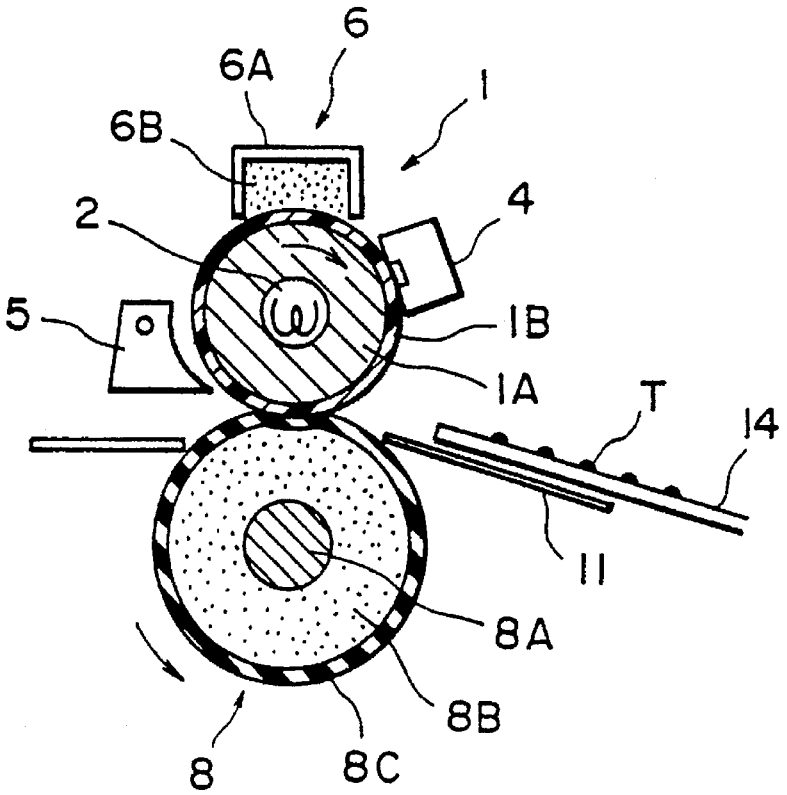
FIG. 4 is a cross-sectional view of an image fixing device according to another embodiment of the present invention.

Referring to FIG. 4, a further embodiment of the present invention will be described. The back-up roller 8 in this embodiment includes a core metal 8A, a porous silicone rubber layer 8B and a thin silicone rubber layer 8C as a surface layer covering the porous silicone rubber layer.

The roller having a core metal and a silicone rubber thereon as in the case of the back-up roller 3 shown in FIG. 1, it is difficult to heat under low temperature conditions, and the thermal capacity is so large that the fixation is not good. If the sheet material is a thin sheet or an envelop (60 g/cm$^2$ or less) or the like is used, it is easily creased. On the other hand, a roller having a porous silicone, rubber layer as an inside layer, as shown in U.S. Pat. No. 4,533,231, is low in the thermal conductivity due to the existence of a large amount of air in the porous elastic layer, and the fixiativeness under low temperature conditions is good, and since the elasticity of the roller is larger than the porous elastic layer, the thin sheet or envelope are not creased. However, the roller having the porous elastic layer involves a defect that the amount of the toner off-set is large. This is because the surface of the back-up roller is electrically charged to the polarity, the same as that of the toner, so that the toner image of the sheet material is repelled to the fixing roller 2, and this occurs as in the FIG. 1 embodiment.

In the fixing apparatus using a roller having a porous elastic layer, the nip pressure between the rollers can not be higher than in the fixing device using a roller having a single rubber layer on the core metal, due to its structure, and therefore, the force for pressing and fixing the toner image on the sheet material is weaker, so that the toner is more easily offset to the fixing roller. When a back-up roller having a silicone rubber layer on a porous elastic layer is used with an image fixing roller having a surface layer of a fluorine resin, the triboelectrification potential created by the friction between the rollers was measured with the use of a sheet of paper for the sheet material. The measurements after the sheet was passed through the nip therebetween, was +2 KV in the case of the fixing roller, and was −3 KV or higher (absolute value) in the case of the back-up roller. If the toner was negatively charged, the amount of the toner off-set to the fixing roller was significantly large.

Now the description will be made with respect to FIG. 4. The fixing device includes a heat-fixing rotatable member 1 and an elastic back-up elastic member 8, wherein the fixing rotatable member is heated by a halogen heater 2.

The fixing rotatable member 1 and the back-up rotatable member 8 may be in the form of rollers or belts, but in this embodiment, they are in the form of rollers. The fixing roller 1 includes a core metal pipe 1A having a diameter and made of a cylindrical aluminum or stainless steel pipe and having a thickness of 0.7–2.0 mm and a surface layer 1B of PFA or PTFE (polytetrafluoroethylene resin) having a thickness of 50–300 microns.

To the surface of the fixing roller 1, a temperature sensing element 4 such as thermister or the like is contacted to detect and control the surface temperature thereof. To the surface of the fixing roller 1, a cleaning pad 6 is press-contacted to the surface of the fixing roller to apply a parting agent thereto and to remove the off-set toner. In this embodiment, the cleaning pad 6 includes a heat-resistive felt 6B made of fluorine resin containing a parting agent and a heat resistive resin frame 6A for fixing the felt 6B. The structure of the fixing roller is substantially the same as FIG. 1 embodiment as will be understood from the foregoing description. The back-up roller 8 contacted to the fixing roller 1, as described hereinbefore, includes a core metal 8A, a porous silicone rubber layer 8B thereon and a silicone rubber layer 8C thereon. The core metal 8A is made of a plated steel or a stainless steel.

The silicone rubber layer 8B has a higher hardness and a smaller thickness than the porous silicone rubber layer 8B.

The sheet material 14 is fed through an inlet guide 11 into the nip formed between an image fixing roller 1 and the back-up roller 8, and the toner image T is fixed by heat on the sheet material 14. The fixing roller 1 is driven by a driving means such as a motor (not shown) or the like, and the back-up roller 8 is driven by the fixing roller 1. The rollers are pressed by force of 4–10 kg, and the fixing roller is heated up to 160°–190° C. by the halogen heater 2.

The core metal 1A of the back-up roller 8 is usually 8–14 mm or more in diameter because of the necessity from the required structural strength. The porous silicone rubber 8B includes substantially independent pores. The thickness of the layer is not less than 2 mm and not more than 20 mm, preferably. The rubber hardness is 20–40 degrees (rubber hardness measuring device ASKAR C), and this softness is preferable. Further, the hardness of the silicone rubber layer on the porous silicone rubber layer 8B is preferably 30–50 degrees (JIS-A) and preferably has a thickness of 0.5–2 mm. As for the method of manufacturing the rotatable member for the porous elastic layer may be as disclosed in U.S. Pat. No. 4,533,231.

In the back-up roller 8, the second elastic layer, that is, the silicone rubber layer 8C is higher in hardness and smaller in thickness than the first elastic layer, that is, the porous silicone rubber layer 8B. This is because if the second elastic layer 8C, that is, the surface layer has a low hardness or large thickness, the advantageous effect of low elasticity of the first elastic layer 8B (the porous silicone rubber layer) is not sufficiently provided.

According to this invention, a fluorine surface-active agent is added in the silicone rubber layer 8C, the second elastic layer. As for the material for the fluorine surface-active agent (EFTOP-EF122B a trade name of a fluorinated surface-active agent, available from Mistubishi Kinzoku Kabushiki Kaisha, Japan).

For the same reasons as described with respect to FIG. 1 embodiment, the flourine surface-active agent content in the silicone rubber layer 8C is preferably not less than 0.003% by weight, and further preferably not less than 0.01% by weight. Also, from the standpoint of the problem of obstruction to the hardening, it is preferably not more than 0.3% by weight, and further preferably not more than 0.1% by weight.

The fluorine surface-active agent used in FIG. 4 embodiment may be the same as in FIG. 1 embodiment.

Figure 5:
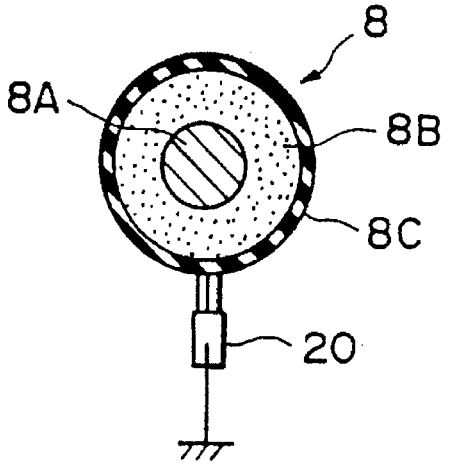
FIG. 5 is a cross-sectional view of a back-up roller of an image fixing device according to a further embodiment of the present invention.

In the image fixing apparatus shown in FIG. 4, the fixing roller 1 includes a metal pipe 1A having a diameter of 20 mm, a thickness of 1.5 mm and made of aluminum and a surface layer of PFA resin layer 1B having a thickness of 100 microns. A spring (not shown) of a conductive material is contacted to a longitudinal end surface of the pipe 1A to ground the fixing roller. The back-up roller 8 includes a core metal shaft 8A made of a stainless steel and having a diameter of 10 mm, an elastic layer 8B made of a porous silicone rubber (rubber hardness of 30 degrees and thickness of 4 mm) and a surface silicone rubber layer 8C on the porous silicone rubber layer (rubber hardness of 40 degrees, thickness of 1 mm). In the silicone rubber layer 8C, 0.1% by weight of the fluorine surface-active agent (EFTOP) is added. To the surface layer 8C of the back-up roller 8, a conductive brush 20 is contacted as shown in FIG. 5 to remove the surface charge of the back-up roller 8.

By adding the EFTOP into the surface layer 8C of the back-up roller 1, the surface potential of the back-up roller 8 is decreased from not less than −2 KV (conventional device) to minus several hundreds V.

The fixing device of FIG. 4 having the structure described above was incorporated into a laser beam printer using a negatively charged toner, and continuous testing operation was performed. The test results showed that the amount of the toner off-set was decreased, and that the cleaning pad 6 was hardly contaminated. Even after 100,000 sheet materials were processed at a process speed of 8 sheets/min., no change was observed. Further, when not only the silicone oil but also the fluorine surface-active agent (0.5–10% by weight with respect to the silicone oil) were impregnated in the cleaning pad 6, the toner offset was further decreased, and the durability of the back-up roller 8 itself was increased.

Figure 6:
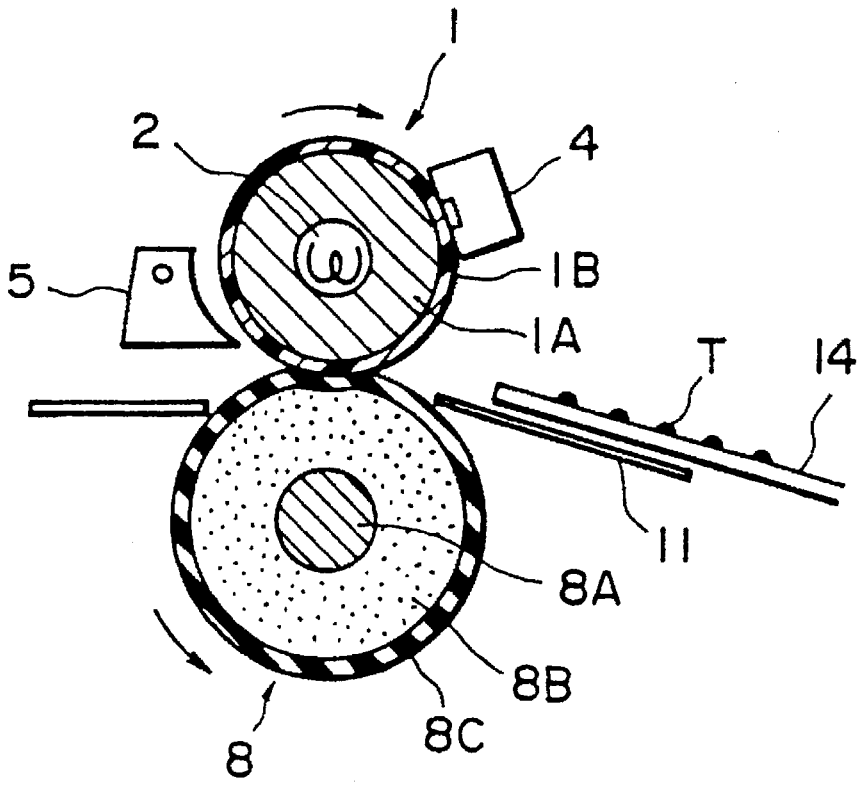
FIG. 6 is a cross-sectional view of an image fixing device according to a yet further embodiment of the present invention.

Referring to FIG. 6, a further embodiment of the present invention will be described, wherein no cleaning pad 6 is provided for the fixing roller 1, and no application of the silicone oil is made to the fixing roller 1. The surface of the fixing roller 1 is formed of PFA resin layer 1B having a thickness of 0.1 mm in which carbon particles are dispersed. The core metal 1A is grounded by grounding means such as a leaf-spring or the like (not shown). The carbon particles contained in the PFA resin layer 1B is preferably of a volume resistivity of not more than $10^{11}$ ohm.cm, and the content thereof is preferably 0.1–5% by weight. By adding the carbon which is an electrically conductive material, the surface potential (higher than +2 KV) of the fixing roller 1 by triboelectrification can be remarkably decreased.

By decreasing the resistance of the surface layer of the fixing roller (volume resistivity of not more than $10^{14}$ ohm.cm), the surface potential of the fixing roller is decreased, by which the amount of the surface-active agent content in the back-up roller can be decreased.

The back-up roller 8 includes an elastic layer 8B made of a porous silicone rubber containing the fluorine surface-active agent and a silicone rubber layer 8C containing the fluorine surface-active agent thereon. The core metal 8A is grounded by way of a conductive bearing or a conductive spring (not shown).

In this embodiment, the surface-active agent is contained not only in the surface layer 8C of the back-up roller but also in the porous silicone rubber layer 8B. By containing the conductive material in the porous silicone rubber layer, the surface layer of the back-up roller can be electrically grounded simply by grounding the core metal 8A.

The porous silicone rubber layer 8B of the back-up roller 8 preferably contains 0.01–3.0% by Weight of a fluorine surface-active agent with respect to the entire amount of the rubber. If it is larger than 3.0%, problems occur in vulcanization and/or foaming, with the result that sufficient porosity is not obtained.

With respect to the porous silicone rubber layer, if it is less than 0.01%, the problem occurs that the sufficient conductivity is not provided. In this embodiment, it is 0.1–0.5% by weight.

The image fixing device according to this embodiment is incorporated into a laser beam printer using a negatively charged toner, and the continuous testing operation was performed similarly to the foregoing embodiments. After 50,000 sheets were processed at a process speed of 5 sheets/min., continuously, there was hardly any toner off-set and this without cleaning of the fixing roller, without application of the silicone oil, without contact of a conductive brush 20 as shown in FIG. 2.

This is because by containing the surface active agent, the surface potential of the back-up roller decreases, thus decreasing the amount of off-set, and in addition, the toner off-set to the fixing roller is collected to the back-up roller by the effect of the surface-active agent, and then, the thus collected toner is deposited onto the backside of the sheet material, by which the toner is discharged to outside of the device. By this, the necessities of the cleaning of the fixing roller and the application of the parting agent are eliminated.

In this embodiment, by adding the fluorinated surface-active agent in the porous silicone rubber layer 8B of the back-up roller 8, the volume resistivity of the porous layer 8B is decreased. As another method, conductive fibers such as carbon fibers are added in the porous layer 8B, but a surface-active agent is preferable since the fibers deteriorates the elasticity of the porosity.

Also, the surface activation effect enhances the bonding strength between the porous layer 8B and the surface layer 8C.

Figure 7:
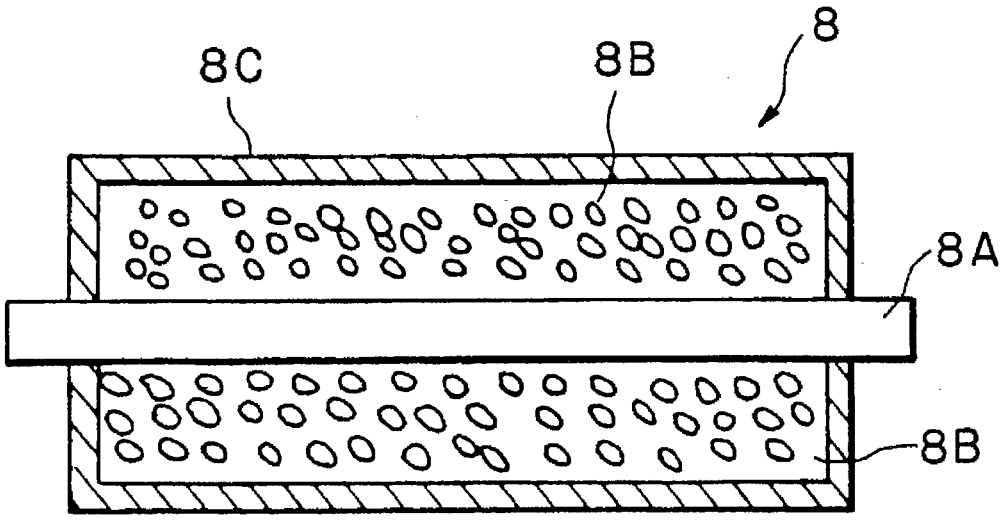
FIG. 7 is a longitudinal sectional view of a back-up roller applicable to the present invention.

Referring to FIG. 7, there is shown a back-up roller 8 of an image fixing device according to a further embodiment of the present invention. The silicone rubber layer 8C containing a fluorine surface active agent is extended to an end of the back-up roller 8, and the charge produced on the surface of the silicone rubber layer 8C is released through the core metal 8A. By doing so, the necessity of using a conductive material for the first elastic layer 8B of the back-up roller is eliminated, and also the necessity of contacting a conductive brush to the surface of the roller is eliminated. The grounding can be provided by grounding the core metal 3 by a conductive bearing or contacting a conductive spring to a core metal 8A.

Figure 8:
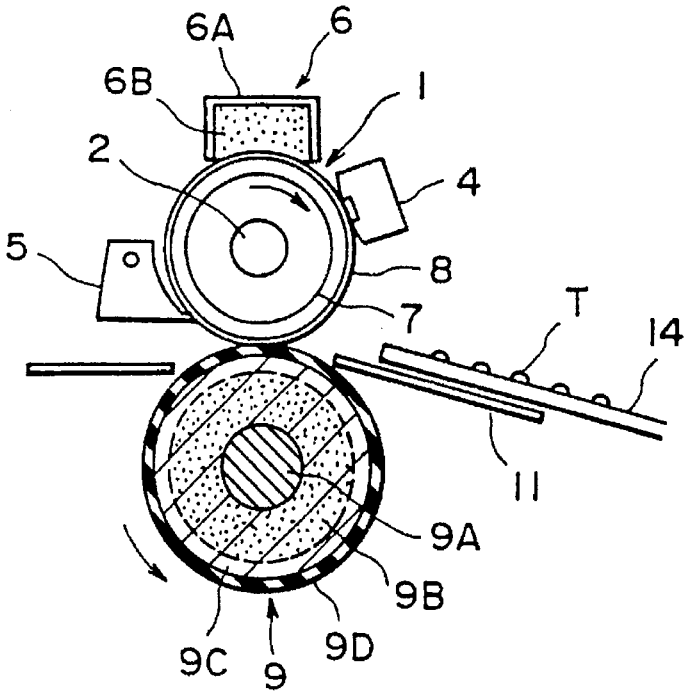
FIG. 8 is a cross-sectional view of an image fixing device according to a still further embodiment of the present invention.
Figure 9:
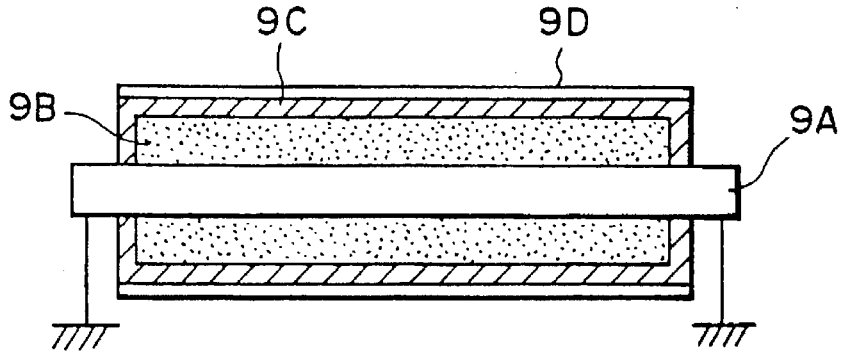
FIGS. 9 and 10 are longitudinal sectional views of back-up rollers usable with the present invention.

Referring to FIG. 8, a further preferable embodiment will be described, wherein a back-up roller 9 includes a core metal 9A of a plated steel or a stainless steel, a porous silicone rubber layer 9B thereon, and a conductive layer 9C covering the entire surface of the layer 9B so as to contact core metal and containing conductive particles such as carbon particles (FIG. 9). The outer periphery of the conductive layer 9C is covered with a thin silicone rubber layer 9D. In the rubber layer 9D, a fluorine surface-active agent is contained.

When conductive material is mixed into the porous silicone rubber layer, there is a tendency of occurrence of a trouble in foaming. As described hereinbefore, it is preferable that the content is not more than 3% by weight even if the fluorine surface active agent is used. In this embodiment, the porous silicone rubber layer does not contain conductive material, but the porous material is covered with a conductive layer exhibiting an elasticity so that the surface layer is a low resistivity layer. By this, the charge on the roller surface can be released to the ground through the core metal, whereby the off-set can be prevented, and the image contamination can be minimized.

In the conventional device, a charge removing brush is necessiated to remove the charge from the roller surface, but according to this embodiment, the necessity of the brush is eliminated, and the grounding can be effected by way of the core metal.

In the foregoing embodiment, a conductive layer containing carbon particles is formed between the surface layer and the porous rubber layer. In place of the conductive layer, a conductive primer for contacting the surface layer with the porous rubber layer may be used with the same results.

Figure 10:
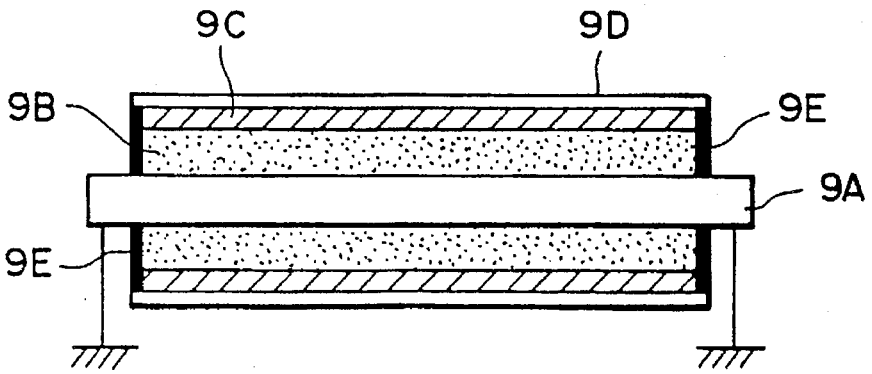

Also, the end of the conductive layer, that is, the second elastic layer is extended to the core metal so as to cover the inside sponge layer, but as shown in FIG. 10, aluminum or stainless steel conductive member 9E may be externally attached to the back-up roller to release the surface charge of the roller to the ground by way of the core metal. However, if the aluminum or stainless steel is provided at the side of the back-up roller, the elasticity decreases in the end portion, and for this reason, it is preferable that a conductive layer having an elasticity is contacted to the core metal.

As described in the foregoing, according to the present invention, the off-set to the image fixing rotatable member can be minimized, and in addition, the slight amount of offset toner is collected to the back-up roller, and the collected back-up roller is discharged outside the device on the backside of the sheet material. Therefore, the parting agent application mechanism and the cleaning mechanism for the image fixing rotatable member can be eliminated.

While the invention has been described with reference to the structures disclosed herein, it is not confined to the details set forth and this application is intended to cover such modifications or changes as may come within the purposes of the improvements or the scope of the following claims.

What is claimed is:

1. An image fixing elastic rotatable member, comprising:

a core member; and a surface silicone rubber layer outside said core member;

wherein said surface silicone rubber layer contains 0.003–0.3% by weight of a fluorine surface active agent.

2. A member according to claim 1, wherein said silicone rubber layer comprises 0.01–0.1% by weight of a fluorine surface active agent.

3. A member according to claim 1, wherein between said silicone rubber layer and said core member, there is provided an insulating rubber layer.

4. A member according to claim 3, wherein said insulating rubber layer is a porous layer.

5. A member according to claim 1, wherein said rotatable member forms a nip for feeding a material having the toner image.

6. A member according to claim 5, wherein said member is contactable to a material having the toner image at a surface not bearing the image.

7. A member according to claim 1, wherein a fluorine surface active agent is applied to said rotatable member.

8. A member according to claim 1, wherein said surface silicone rubber layer is hardened while containing said fluorine surface active agent.

9. An image fixing apparatus, comprising:

a heating member;

a back-up rotatable member, said back-up rotatable member having a core member and a surface silicone rubber layer outside said core member, wherein said surface silicone rubber layer contains 0.003–0.3% by weight of a fluorine surface active agent.

10. An apparatus according to claim 9, wherein said core member is electrically conductive, and said silicone rubber layer is electrically connected with said core member.

11. An apparatus according to claim 9, wherein said silicone rubber layer comprises 0.01–0.1% by weight of a fluorine surface active agent.

12. An apparatus according to claim 9, wherein between said silicone rubber layer and said core member, there is provided an insulating rubber layer.

13. An apparatus according to claim 12, wherein said insulating rubber layer is a porous layer.

14. An apparatus according to claim 9, wherein a fluorine surface active agent is applied to said rotatable member.

15. An apparatus according to claim 9, wherein said heating member is contactable to an unfixed toner image charged to a negative polarity on a recording material, and wherein said silicone rubber layer is a surface layer.

16. An apparatus according to claim 9, wherein said surface silicone rubber layer is hardened while containing said fluorine surface active agent.

* * * * *